United States Patent [19]

Noguchi et al.

[11] 4,189,390

[45] Feb. 19, 1980

[54] ONE-COMPONENT MAGNETIC DEVELOPER POWDER FOR DEVELOPING ELECTROSTATIC LATENT IMAGE AND METHOD OF MAKING SAME

[75] Inventors: Koji Noguchi, Kumagaya; Toshio Kumakura, Omiya; Akio Mukoh, Hitachi; Yasuki Mori, Hitachi; Hirosada Morishita, Hitachi, all of Japan

[73] Assignee: Hitachi Metals, Ltd., Japan

[21] Appl. No.: 846,890

[22] Filed: Oct. 31, 1977

Related U.S. Application Data

[63] Continuation of Ser. No. 659,360, Feb. 19, 1976, abandoned.

[30] Foreign Application Priority Data

Feb. 21, 1975 [JP] Japan ..... 50/20989

[51] Int. Cl.[2] ..... G03G 9/14

[52] U.S. Cl. ..... 430/111; 252/62.54; 427/113; 427/122; 427/127; 427/180; 427/221

[58] Field of Search ..... 252/62.1 P, 62.1 R, 252/62.53, 62.54; 96/1 SD; 427/18

[56] References Cited

U.S. PATENT DOCUMENTS

| | | | |
|---|---|---|---|
| 3,239,465 | 3/1966 | Rheinfrank | 252/62.1 P |
| 3,627,682 | 12/1971 | Hall et al. | 96/1 SD |
| 3,639,245 | 2/1972 | Nelson | 252/62.1 P |
| 3,752,666 | 8/1973 | Hagenbach et al. | 252/62.1 P |
| 3,925,219 | 12/1975 | Strong | 252/62.1 P |

*Primary Examiner*—Roland E. Martin, Jr.
*Attorney, Agent, or Firm*—Finnegan, Henderson, Farabow & Garrett

[57] ABSTRACT

A one-component magnetic developer powder for developing an electrostatic latent image formed according to an electrophotographic process comprising non-agglomerative essentially spherical members consisting essentially of plastics binder, magnetic particles and first electric conductive particles dispersed therein, and second electric conductive particles embedded on a spherical surface of the member, the resistivity of the surface layer of the powder being less than that of the inner portion.

The developer powder according to the present invention has a good electrical uniformity and the flowability of the developer powder is very good. Productivity of the same is also very good.

13 Claims, No Drawings

ONE-COMPONENT MAGNETIC DEVELOPER POWDER FOR DEVELOPING ELECTROSTATIC LATENT IMAGE AND METHOD OF MAKING SAME

This is a continuation application Ser. No. 659,360, filed Feb. 19, 1976 now abandoned.

This invention relates to electrophotography and more particularly to improved one-component magnetic developer powder adapted for developing an electrostatic latent image formed according to an electrophotographic process.

A conventional method of preparing developer powder for developing an electrostatic latent image comprises the steps of mixing plastics binder and magnetic particles at a temperature at which the plastic binder fuses, pulverizing the mixture after cooling, dispersing the resulting particles into a hot air stream, thereby spheroidizing the particles into spherelike shapes, mixing the spheroidized particles with electric conductive particles, dispersing the resulting mixtures into a hot air stream again, thereby embedding the electric conductive particles on the surface of the spheroidized particles and classifying the particles in an appropriate particle size.

Another conventional method of preparing developer powder comprises the steps of mixing plastics binder and magnetic particles at a temperature at which the plastics binder fuses, pulverizing the mixture after cooling, classifying the resulting particles in an appropriate particle size, dispersing the particles into an insoluble hot liquid which disperses electric conductive particles therein, and drying the resulting particles after rinsing, thereby spheroidizing the particles into spherelike shapes and embedding the electric conductive particles on the surface of the particles.

The developer powder made by these methods is called one-component magnetic powder and has the structure of relatively insulative core and electric conductive outer layer, Moreover, the developer powders display low resistivity under the high electrical field and display high electric resistivity under the low electrical field. Consequently, the developer powder has good electrical charge retention after they are removed from the high electrical field. It is said that charge retention is important when one desires to transfer the developer powder from photoconductor to a support.

However, the pulverized particles made by these methods do not contain electric conductive particles therein, so that they are very agglomerative. Consequently, in the former method of preparing developer powders, it is very difficult to disperse uniformly the pulverized particles into a hot air stream, whereby an average particles size increases. Moreover, it is difficult to dispose uniformly the electric conductive particles on the resulting spheroidized particle in the mixing step, therefore the developer powder prepared would not have uniform electric conductive outer layer. In the latter method, the developer powder would not have uniform electric conductive outer layer also and productivity of this method is not so good.

An object of the invention is to provide an improved one-component magnetic developer powder for developing an electrostatic latent image.

Another object of the invention is to provide an improved magnetic developer powder easy to prepare or manufacture.

A further object of the invention is to provide an improved magnetic developer powder which has uniform electric properties.

A still further object of the invention is to provide an improved magnetic developer powder which has good flowability.

These objects can be widely attained with a new developer powder which comprises non-agglomerative essentially spherical members consisting essentially of plastics binder, magnetic particles and first electric conductive particles dispersed therein, and second electric conductive particles embedded on the spherical surface of the member, the resistivity of the surface layer of the developer powder being less than that of the inner portion.

One preparing method of the developer powder of the invention comprises the steps of mixing plastics binder, magnetic particles and first electric conductive particles at a temperature at which the plastics binder fuses, pulverizing the mixture after cooling, dispersing the pulverized particles into a hot air stream, thereby spheroidizing the non-agglomerative particles into spherelike shapes, mixing the spheroidized particles with second electric conductive particles, dispersing the resulting mixtures into a hot air stream again, thereby embedding the second electric conductive particles on a surface of the particles and classifying the particles in an appropriate particles size. Spray drying method can be used also.

We have found out it effective for improving the properties of the developer powder which comprises non-agglomerative essentially spherical members consisting essentially of plastics binder, magnetic particles and first electric conductive particles dispersed therein, and second electric conductive particles embedded on the spherical surface of the member, the member having a resistivity ranging between $10^2$ and $10^{12}$ Ωcm in a D.C. 100 volts/cm electrical field, the resistivity of the surface layer of the powder being less than that of the inner portion, and the average resistivity is in the range of $10^2$ to $10^8$ Ωcm in a D.C. 100 volts/cm electric field. In consequence, the developer powder prepared according to this invention does not have remarkable insulative portions.

We have found out moreover that, (1) the pulverization of the developer material prepared according to this invention is very easy and the pulverized developer powders are very fine, (2) the flowability of the pulverized developer powder is very good, so that the particle size increases very little in the spheroidizing process, (3) the essentially spherical members prepared by this method are non-agglomerative and flowable, consequently the electric conductive particles are able to disperse uniformly on the surface of the member.

(4) therefore, the uniform electric conductive layer is formed on the surface of the developer powder, and the electric properties of the developer powders have good reproducibility.

(5) the flowability of the developer powder is better than that of conventional developer powder, (6) and the properties of developed image, for example, image resolution, adhesiveness, background and half tone, are comparable to conventional developed image, and solid density and unevenness of image are much better than conventional image, (7) furthermore, by using carbon black as electric conductive particles, we are able to get black image, though we use non-black magnetic particles, for example, Mn-Zn ferrite and Ni-Zn ferrite.

These are the great advantage of the developer powder of this invention.

The content of the plastics binder, by weight, is about 30–60%. Preferably, it is about 40–55%. If it is less than 30%, it is difficult to spheroidize the developer particles. Moreover, adhesiveness between developer powder and substrate is not sufficient for fixing. In case it is more than 60%, the content of the magnetic particles is not sufficient for developing with a magnetic roll, so called "magnetic brush" process, that is, the background density increases.

As the plastics binder, thermoplastic resin, thermosetting resin, natural resin, oligomer, mixtures thereof and the like can be used in the developer powder of the invention. The melting point or the softening temperature of the plastics binder is preferably between 60° and 170° C. Further preferably, it is about 75°–130° C.

The developer powders of the invention contain first electrical conductive particles in the inner portions of the powders and second on the surfaces.

The electrical conductive particles of the invention include carbon-black, metal, alloy, oxide and mixtures thereof. For developing black image, it is preferable to use carbon black having a particle size in the range of 10 to 40 mμ.

The content of the first electric conductive particles contained in the inner portions of the developer powder (spherical member), by weight, is about 0.5–8%. In this case, the electric resistivity of the spherical members is in the range of $10^2$ to $10^{12}$ Ωcm in a D.C. 100 volts/cm D.C. electrical field. If it is less than 0.5 %, the spherical members are insulative and become agglomerative. In case it is more than 8%, the contents of the plastics binder and magnetic particles cannot but decrease. Consequently, it is not good for fixing of the developer powder and for developing by the magnetic brush process.

The content of the total electric conductive particles of the developer powder, by weight, is about 1.5–10%. Preferably, it is about 2–9%. Further preferably it is about 4–8%. In this case, the average electric resistivity of the developer powder is in the range of $10^2$ to $10^8$ Ωcm in a D.C. 100 volts/cm electrical field.

Using a developer powder in CPC (Coated Paper Copy) method, the average electric resistivity of the developer powder is preferably in the range of $10^2$ to $10^6$ Ωcm under the same conditions. If it is more than $10^6$ Ωcm, the solid density of the image is very low by magnetic brush developing process. In case it is less than $10^2$ Ωcm, the half tone of the image is not very good.

Using a developer powder in PPC (Plain Paper Copy) method containing corona transfer or electric bias transfer, the average resistivity of the developer powder is preferably in the range of $10^5$ to $10^8$ Ωcm under the same conditions. If it is less than $10^5$ Ωcm, the transferring efficiency of the developer powder from photoconductor to plain paper is on the decrease. If it is more than $10^8$ Ωcm, it is difficult to develop an electrostatic latent image on photoconductor with conventional magnetic brush process. That is, outside the range between $10^5$ and $10^9$ Ωcm in a 100 volts/cm D.C. electrical field, the solid density of the developed image is very poor.

Electric resistivity measurements of the invention are made with developer powder formed into a 1 $cm^2 \times 1$ cm shape between mercury electrodes.

The content of magnetic materials, by weight, is about 35–65%. Preferably, it is about 40–60%. If it is less than 35%, magnetic force of the developer powder is not sufficient for developing an electrostatic latent image with a magnetic brush process. That is, the developer powder is scattered from magnetic roll easily, consequently, background density and resolutions of copied image become worse. In case it is more than 65%, the fixing of the copied image becomes worse.

The magnetic particles of the invention include metal powders, alloy powders, magnetic oxides, such as, magnetite, MnZn ferrite, NiZn ferrite, Ba ferrite, chromium oxide and mixtures thereof. For obtaining black image, it is preferable to use magnetite having a particle size in the range of 0.1 to 1.0μ.

The essentially spherical members of the invention may still contain dry lubricating material, which improves the flowability of the members. Consequently, it is easy to disperse the members into a hot air stream in spheroidizing process. Furthermore, the particle size of the members does not increase in this process. It is preferable that the content of dry lubricating material, by weight, is about 0.1–1.0%. Furthermore preferably it is about 0.2–0.5%. If it is less than 0.1%, the flowability of the developer powder is not improved effectively. If it is more than 1.0%, the flowability is not improved further.

The developer powder of this invention may further contain dry lubricating material, which improves the flowability of the developer powder in the magnetic brush developing device. However, the electric resistivity and triboelectric property of the developer powder are strongly influenced by dry lubricating material. If the content of the dry lubricating material is excessive, the properties of developed image, for example, image resolution, background and unevenness of image, become worse. These effects are strong upon lower resistivity developer powder. Appropriate dry lubricating materials include stearate compounds, silica, alumina and the like having a particle size in the range of 3 to 40mμ.

The developer powders of the invention have very good flowability, therefore, the dry lubricating material is not especially necessary. However, in higher electric resistive powder of the invention, the developer powder may have up to 0.5 % of dry lubricating silica added thereto.

The particle size of the developer powder of the present invention is about 1–100μ. Preferably, it is about 5–40μ for obtaining good image, for example, background, resolution and half tone.

Using light-colored or transparent magnetic particles, for example, metal and alloy magnetic particles, ferrite and transparent magnetic materials, light-colored or transparent electric conductive materials, for example, metal and alloy particles and electric conductive polymer, plastics binder, and coloring materials selected from the group consisting of dye and pigment, we can obtain colored magnetic developer powders.

As mentioned earlier, the developer powder of this invention is better than the conventional powder concerning flowability and uniformity of electric resistivity especially. In consequence, by using the developer powder of this invention, properties of copied image such as unevenness of developed image, background, resolution and the like are excellent particularly.

This invention is further illustrated by the following examples but it is to be understood that the scope of the invention is not to be limited thereby. All parts and percentages are by weight unless otherwise stated.

EXAMPLE 1

Six kinds of magnetic developer materials shown in Table 1 were prepared, wherein the resin consisted of seven parts of micro-crystalline wax (Microcrystal Wax-220, Mobil Oil Chemical) and three parts of ethylene-vinyl acetate copolymer (Evaflex 310, Mitsui Polychemical Co.). Carbon black and magnetite were Carbon Black #44 (Mitsubishi Kasei Co.) and Magnetite (Titan Kogyo Co.), respectively.

Table 1

| Magnetic Developer Powder Materials | | | | | | |
|---|---|---|---|---|---|---|
| | Sample No. | | | | | |
| Composition | 1 | 2 | 3 | 4 | 5 | 6 |
| Carbon Black (wt %) | 0 | 0.5 | 1 | 5 | 7 | 10 |
| Resin (wt %) | 40 | 49.5 | 49 | 45 | 43 | 40 |
| Magnetite (wt %) | 60 | 50 | 50 | 50 | 50 | 50 |

We prepared each developer powder by the following method. We first obtained the mixture of the resin and the carbon black (if any) by a conventional rubber rollers-mill at a temperature between 130° and 160° C. Next, we obtained homogeneous mixture by adding magnetite gradually to the mixture and mixing it by the same rubber-rollers mill at a temperature between 150° and 170° C. Then, we obtained the fine powder of each mixture less than 100μ in particle size by pulverizing first in conventional "atomizer", next in conventional vibration mill for 30 hours, and classifying it by conventional classifying machine. The yield of the conventional developer powder material (Sample No. 1) was about 78%, which did not contain any carbon black.

On the other hand, the yields of the developer powder material according to the invention, (Sample No. 2–No. 6) were about 88 to about 94%, which contained carbon black. The magnetic developer powder material without carbon black (Sample No. 1) was very agglomerative, while the magnetic developer powder materials containing at least 0.5% of carbon black were highly improved in the flowability and less agglomerative.

Then we measured the electric resistivity of a cylindrical sample of each material, the size of the cylinder was 1 $cm^2$ (cross-section)×1 cm (height). A 100 volts/cm D.C. electrical field was applied between mercury electrodes. The resistivity of the developer powder (member) without carbon black (Sample No. 1) was at least $10^{12}$ Ωcm, while as for the developer powders (members) containing carbon black the measured values of resistivity were from $3\times10^3$ to $5\times10^{11}$ Ωcm. That is to say, the more the content of carbon black, the less was the resistivity. The resistivity of the developer powders (members) (Sample No. 2, No. 5, No. 6) were $5\times10^{11}$ Ωcm (No. 2), $2\times10^7$ Ωcm (No. 5) and $3\times10^3$ Ωcm (No. 6), respectively.

With the above-mentioned magnetic developer powders, electrostatic latent images were developed according to the well-known electrophotographic process. As for the developer powder without any carbon-black (Sample No. 1), a clear duplicated image could not be obtained. But we obtained clear duplicated image by the developer powders containing carbon black. The image became clearer as the content of carbon in the developer powder increased.

Then we obtained essentially spherical members by spheroidizing the finely pulverized developer powders in hot aerosol at a temperture between 505° and 535° C. Further we added 1% of fine carbon black particles on the surfaces of the developer particles and embedded them thereon by the same heating process as the spheroidizing process. The temperature of hot aerosol was kept between 390° and 420° C. Thus we obtained the essentially spherical magnetic developer particles with highly electric conductive surface layers thereon.

Again we measured the resistivity of the developer powders by the same method mentioned above. The resistivity of the conventional developer powder (Sample No. 1) which contained carbon-black only on the surface layer, was $2\times10^9$ Ωcm in a 100 volts/cm D.C. electrical field. As for the developer powder according to the present invention, the measured values of resistivity were $7\times10^7$ Ωcm (Sample No. 2; carbon black, 0.5%), $8\times10^3$ Ωcm (Sample No. 5; carbon black 7%) and $3\times10^3$ Ωcm (Sample No. 6; carbon-black, 10%), respectively. As for the developer particles (No. 6) which contain about 10% of carbon black under the surface layer and carbon-embedded surface layer, the resistivity did not change effectively after the 1% of carbon-black had been embedded. Therefore, it was apparent the developer powder did not have electrically multi-layer structure.

0.3% of fine powdered silica (Particle size; 3–10 mμ) was added on the surfaces of each developer powders mentioned above to improve flowability. Then we measured how long it took for 100 grams of each developer powder to fall through a conventional funnel. Ten measurements were done for each developer powder. It took about 48 to 55 seconds for the conventional developer powder (Sample No. 1) which contained carbon black only in the surface layer. On the other hand it took only 34 to 49 seconds for the developer powders according to the present invention which contained carbon-black both in the core and on the surface. According to the above-mentioned results, it was apparent that the flowability of the developer powder according to the invention was superior to that of the conventional developer powder.

With the magnetic developer powders containing finely powdered silica on the surface thereon, electrostatic latent images were developed and fixed according to the CPC and PPC methods of the conventional electrophotographic processes. Duplicated images satisfied the requirements of resolution. However, the solid density, gloss and contrast ratio of duplicated image with the conventional developer powder was inferior to those with the developer powders according to the present invention.

Fixing properties of duplicated images were excellent for the developer powders which contained carbon black of not more than 7% (Sample No. 1–5), but fixing properties for the developer powder (Sample No. 6) containing 10% of carbon black was a little inferior to the other developer powders due to large content of carbon black.

EXAMPLE 2

Two kinds of magnetic developer materials shown in Table 2 were prepared, wherein the resin consisted of 6.5 parts of crystalline wax (Mitsui Polychemical Co., Hi Wax 400P) and 3.5 parts of ethylene-vinyl acetate copolymer (Mitsui Polychemical Co., Evaflex 420), and other components were carbon black (Cabot Co., Super Ba Powder) and magnetite (Toda Kogyo Co., Magnetite).

Table 2

| Composition | Sample No. 7 | Sample No. 8 |
|---|---|---|
| Carbon Black (wt %) | 0 | 5 |
| Resin (wt %) | 40 | 45 |
| Magnetite (wt %) | 60 | 50 |

By the same method as EXAMPLE 1, we obtained finely powdered developer materials of homogeneous mixture of carbon black, resin and magnetite by blending (rubber-roller mill), pulverizing and classifying. The particle size of classified particles was less than 100μ. The yield of conventional developer particle (Sample No. 7) which contained no carbon black was about 75%, while the yield of the developer particle (Sample No,. 8) according to the present invention which contained carbon-black, was about 91%. By the same method as EXAMPLE 1, we measured the electric resistivity of developer particles. The results obtained were $10^{12}$ Ωcm (Sample No. 7) and $2\times10^{9}$ Ωcm (Sample No, 8), respectively in a 100 volts/cm D.C. electrical field.

By the same method as EXAMPLE 1, we spheroidized the fine developer particles mentioned above in hot aerosol, blended 1.5% of carbon black on the surface of them and then heated them in hot aerosol again. We obtained the magnetic developer powders of spherical particles embedded with high density of carbon black on the surface of them.

We again measured the resistivity of those developer powders. The developer powder containing carbon black only in the surface layer (Sample No. 7) was $8\times10^{8}$ Ωcm and the developer powder containing carbon black both in the core and on the surface (Sample No. 8) was $5\times10^{4}$ Ωcm.

0.5% of finely powdered silica was added to each of those developer powders mentioned above, and then each mixture was blended carefully. Then the falling time passing through a funnel was measured by the same method as EXAMPLE 1. The falling time for the conventional developer powder (Sample No. 7) was about 51 to 59 seconds. On the other hand, the falling time for the developer powder according to the present invention (Sample No. 8) was about 43 to 46 seconds and the variation of falling time was less. It was evident that the flowability of the developer powder according to this invention was superior to the conventional developer powder.

With both developer powders, electrostatic latent images were developed and fixed according to the PPC and CPC methods of the conventional electrophotographic process. With each developer powder, we obtained duplicated images which satisfied the requirements of resolution and fixing properties. However, with the developer powder containing carbon black both in the core and on the surface (Sample No. 8), we obtained duplicated images which are glossier, higher in solid density and less in unevenness of image.

EXAMPLE 3

The mixture of 55 parts of styrene resin (Mitsubishi-Monsanto Chemical; Sanrex), 5 parts of carbon-black (Mitsubishi Chemical; Carbon Black #44) was homogeneously mixed by rubber-rollers mill at a temperature between 130° and 150° C., and then 40 parts of magnetite (Titan Kogyo Co.) was added little by little to the mixture and it was mixed homogeneously by the same rubber-rollers mill at a temperature between 150° and 170° C.

After the mixture was cooled, it was pulverized and classified by the same method as EXAMPLE 1. The classified powder was compressed into a cylinder (cross-section, 1 $cm^2$; height, 1 cm) for the measurement of resistivity. The measured value of resistivity was $2\times10^{9}$ Ωcm in a 100 volts/cm D.C. electrical field.

The classified particle was spheroidized in hot aerosols. 1% of carbon black was added on the surfaces of the spheroidized particles and it was heated in hot aerosol again. Thus we obtained essentially spherical black, magnetic developer powders which have high density of carbon-black embedded in the surface layers of the powders.

We measured the resistivity of the magnetic developer powder mentioned above in the same way as EXAMPLE 1, the value obtained was $6\times10^{5}$ Ωcm in a 100 volts D.C. electrical field.

0.2% of finely powdered silica was added to the essentially spherical developer particles and blended homogeneously. With the developer powder, electrostatic images were developed and fixed according to the CPC method of the conventional electrophotographic process. We obtained the duplicated images which satisfied sufficiently the requirements of fixing properties, resolution and the density of the image.

EXAMPLE 4

The mixture of 50 parts of epoxy resin (Shell Oil Chemical Co; Epon 1001), and 7 parts of carbon black (Mitsubishi Kasei Co., Carbon Black #50) was homogeneously mixed by rubber-rollers mill at a temperature between 130° and 150° C., and then 43 parts of Mn-Zn ferrite (Toda Kogyo Co.) was added gradually into the above mentioned mixture and it was mixed by the same rubber-rollers mill at a temperature between 150° and 170° C.

After the mixture was cooled it was pulverized and classified by the same method as EXAMPLE 1. The classified powder was compressed into a cylinder (cross-section, 1 $cm^2$; height, 1 cm) for the measurement of resistivity. The obtained value was $7\times10^{6}$ Ωcm in a 100 volts/cm D.C. electrical field.

The classified particle was spheroidized in hot aerosol; 1% of carbon black was added on the surfaces of spheroidized particles and heated in hot aerosol again. Thus we obtained essentially spherical, black, magnetic developer particles, which have high density of carbon-black embedded in the surface layers of the particles.

We measured the resistivity of the magnetic developer powder mentioned above in the same way as EXAMPLE 1. The value obtained was $8\times10^{2}$ Ωcm in a 100 volts/cm D.C. electrical field.

0.3% of finely powdered silica was added to the spherical developer powders and they were blended homogeneously. With the developer powder, electrostatic latent images were developed and fixed according to the CPC method of the conventional electrophotographic process. We obtained duplicated images which satisfied sufficiently the requirements of fixing properties, resolution and density of the image.

What is claimed is:

1. A one-component magnetic developer powder for developing an electrostatic latent image formed according to an electrophotographic process by the magnetic brush method, the particles of the developer powder being substantially spherical and having an electrically conductive multi-layer structure, said structure having a core portion and a surface layer, said core portion consisting essentially of 40–55% by weight of a plastic binder, 0.5–8% by weight of electric conductive particles dispersed throughout said binder and the balance of magnetite, said core portion having an electric resistivity ranging between $10^2$ and $10^{12}$ ohm-cm in a 100 volts/cm D.C. electrical field, said surface layer comprising additional electrically conductive particles embedded in the surface of the spherical particle forming a greater concentration of electrically conductive particles in the surface layer; the total conductive particles being 1.5–10% by weight; the resistivity of the surface layer of said spherical particle being less than that of the core portion; and the average electric resistivity of said developer powder being in the range of $10^2$ and $10^8$ ohm-cm in a 100 volts/cm D.C. electrical field.

2. A one-component magnetic developer powder according to claim 1, wherein the content of the additional electrically conductive particles is 1.0–2.0% by weight.

3. A one-component magnetic developer powder according to claim 1, wherein the particles of the developer powder have a particle size in the range of 1 to 100μ.

4. A one-component magnetic developer powder according to claim 1, wherein the particles of the developer powder have a particle size in the range of 5 to 40μ.

5. A one-component magnetic developer powder according to claim 1, wherein the plastic binder is selected from the group consisting of thermoplastic resins, thermosetting resins and mixture thereof, the electrically conductive particles having a particle size in the range of 10 to 40 mμ and are selected from the group consisting of carbon-black, metal powders, alloy powders, inorganic oxides and electric conductive polymers, and the magnetite has a particle size in the range of 0.1 to 1μ.

6. A one-component magnetic developer powder according to claim 1, wherein the developer particles powder has an average electric resistivity in the range of $10^2$ to $10^6$ Ωcm in a 100 volts/cm D.C. electrical field.

7. A one-component magnetic developer powder according to claim 1, wherein the developer powder particles comprises up to 1.0 weight % of a dry lubricating powder selected from the group consisting of stearate compounds, silica and alumina, the dry lubricating powder having a particle size in the particle size range of 3 to 40 mμ.

8. A one-component magnetic developer powder according to claim 7, wherein the dry lubricating powder is 0.2 to 0.5 weight % of silica.

9. A one component magnetic developer powder according to claim 1, wherein the plastic binder is selected from the group consisting of microcrystalline wax, ethylene-vinyl acetate copolymer, styrene resin and epoxy resin.

10. A one-component magnetic developer powder according to claim 1, wherein the amount of electric conductive particles contained in the developer powder particles is in the range of 2 to 9 weight %.

11. A one-component magnetic developer powder for developing an electrostatic latent image formed according to an electrophotographic process by the magnetic brush method, the particles of the developer powder being substantially spherical and having an electrically conductive multi-layer structure, said structure having a core portion and a surface layer, said spherical particles having a particle size in the range of 5 to 40μ, said core portion having a electric resistivity in the range of $10^2$ to $10^{12}$ Ωcm in a 100 volts/cm D.C. electric field, said spherical particles consisting essentially of 40 to 55 weight % of a plastic binder selected from the group consisting of thermoplastic resins, thermosetting resins, and mixtures thereof, 0.5 to 8 weight % of electric conductive carbon-black dispersed throughout said core portion and having a particle size in the range of 10 to 4 mμ, 1.0 to 2.0 weight % of electrical conductive carbon-black embedded in the surface layer and having a particle size in the range of 10 to 40 mμ and magnetite having a particle size in the range of 0.1 to 1μ, the total content of carbon-black being 1.5–10 weight %, wherein the developer powder particles have an average electric resistivity in the range of $10^2$ and $10^8$ Ωcm in a 100 volts/cm D.C. electrical field.

12. A one-component magnetic developer powder according to claim 11, wherein the developer powder particles comprises up to 0.5 weight % of silicon dioxide dry lubricating powder blended therewith.

13. A method of preparing a one component magnetic developer powder of essentially spherical particles of improved flowability, each particle having an electrically conductive multi-layer structure, said structure having a core portion and a surface layer, for developing an electrostatic latent image formed according to an electrophotographic process by the magnetic brush developing method comprising the steps of:

mixing 40 to 55 weight % of a plastic binder selected from the group consisting of thermoplastic resins, thermosetting resins, and mixtures thereof, 0.5 to 8 weight % of electric conductive carbon-black having a particle size in the range of 10 to 40 mμ and the balance magnetite having a particle size in the range of 0.1 to 1μ, at a temperature ranging between 130° and 170°0 C.

pulverizing the mixture into particles less than 40μ after cooling, dispersing the pulverized particles into a hot air stream ranging between 500° and 540° C. thereby spheroidizing the particles into core portion particles.

mixing the resulting spheroidized core portion particles with 1.0 to 2.0 weight % of electric conductive carbon-black having a particle size in the range of 10 to 40 mμ, thereby the total content of carbon-black in the spherical particles being 1.5 to 10 weight %.

dispersing the mixture of spheroidized core portion particles and electric conductive carbon-black into a hot air stream ranging between 390° and 420° C. thereby embedding the carbon-black on a spherical surface of the core portion articles, and classifying the particles, each particle having an electrically conductive multi-layer structure, said structure having a carbon-black containing core portion and a carbon-black containing surface layer having an electric resistivity relatively less than that of the core portion, into an appropriate particle size whereby the resulting developer powder has an average electric resistivity in the range of $10^2$ to $10^8$ Ωcm in a 100 volts/cm D.C. electrical field.

* * * * *